US006580408B1

(12) United States Patent
Bae et al.

(10) Patent No.: US 6,580,408 B1
(45) Date of Patent: Jun. 17, 2003

(54) ELECTRO-LUMINESCENT DISPLAY INCLUDING A CURRENT MIRROR

(75) Inventors: Sung-Joon Bae, Kyongki-do (KR); Jin-Sang Kim, Kyongki-do (KR)

(73) Assignee: LG. Philips LCD Co., Ltd., Seoul (KR)

( * ) Notice: Subject to any disclaimer, the term of this patent is extended or adjusted under 35 U.S.C. 154(b) by 0 days.

(21) Appl. No.: 09/521,569

(22) Filed: Mar. 9, 2000

(30) Foreign Application Priority Data

Jun. 3, 1999 (KR) ..... 99-20406

(51) Int. Cl.[7] ..... G09G 3/30
(52) U.S. Cl. ..... 345/76; 345/82; 345/92
(58) Field of Search ..... 345/76, 77, 82, 345/87, 92; 349/33; 327/333; 315/169.3

(56) References Cited

U.S. PATENT DOCUMENTS 5,748,026 A * 5/1998 Maekawa et al. ..... 327/333
6,091,203 A * 7/2000 Kawashima ..... 315/169.3
6,229,506 B1 * 5/2001 Dawson et al. ..... 345/82
6,304,304 B1 * 10/2001 Koma ..... 349/33

OTHER PUBLICATIONS

R.M.A. Dawson, et al., "The Impact of the Transient Response of Organic Light Emitting Diodes on The Design of Active Matrix OLED Displays", IEEE, 1998, pp. 875–878.

* cited by examiner

*Primary Examiner*—Dennis-Doon Chow
(74) *Attorney, Agent, or Firm*—Birch, Stewart, Kolasch & Birch, LLP

(57) ABSTRACT

An electro-luminescent display includes a current mirror for supplying uniform drive currents to the electro-luminescent diodes of the electro-luminescent display. The current mirror is not effected by the various threshold voltages $V_{TH}$ of the switching devices in the electro-luminescent display so that uniform current is output to the electro-luminescent diodes throughout the display. The electro-luminescent display includes a gate line, a data line intersecting the gate line, a first TFT for selecting an arbitrary pixel by a gate signal from the gate line, wherein a gate of the first TFT is connected to the gate line, and a current mirror for outputting a signal to an arbitrary pixel selected by the first TFT by receiving a data signal from the data line at the same time the current mirror is being driven by applied voltage. The current mirror includes a second TFT and a third TFT, and an electro-luminescent diode driven by the signal output from the current mirror.

8 Claims, 4 Drawing Sheets

ELECTRO-LUMINESCENT DISPLAY INCLUDING A CURRENT MIRROR

BACKGROUND OF THE INVENTION

1. Field of the Invention

The present invention relates to an electro-luminescent display (ELD) including a current mirror for uniform illumination throughout the whole display.

2. Discussion of the Related Art

An ELD, into which electrons and holes are injected, uses the recombination between electrons and holes to generate an electro-luminescence. An ELD is a next generation display technology and has the benefits of not requiring a back light, providing a thinner panel, and achieving reduced power consumption.

In an active ELD, a plurality of pixels are defined by a plurality of gate lines and data lines intersecting each other. In the respective pixels, power supply lines are arranged in the same direction as the data lines. A pixel has at least one switching device such as a thin film transistor (TFT), a storage capacitor, and an electro-luminescence (EL) portion.

When an ELD includes a pair of TFTs in each pixel, an EL exciting signal and a scanning signal are used. The EL portion is selected by a logic TFT and exciting power of the EL portion is controlled by the power of the other TFT. A storage capacitor is provided for maintaining the exciting power of the EL portion in the selected cell.

FIG. 1 is a schematic of an equivalent circuit of an ELD according to a related art. Referring to FIG. 1, a plurality of pixel regions are defined by a plurality of gate lines, for example, G1, G2, and data lines, for example, D1, D2, arranged to intersect each other.

First, TFTs M1 are connected to the intersections of the gate lines and data lines, for example, G1 and D1 in a pixel. A storage capacitor $C_{STO}$ and a gate of a second TFT M2 are connected in parallel to a source of the first TFT Ml. An electro-luminescent diode EL, which is a light-emitting device, is connected to a source of the second TFT M2. A gate driver (not shown in the drawing) is connected to one stage of the gate lines and supplies each of the gate lines with a proper scanning signal. A data driver (not shown in the drawing) is connected to one stage of the data lines and supplies each of the data lines with a data voltage for driving a corresponding electroluminescent diode EL.

The following description explains the operation of the above-described ELD. After a first gate line G1 has been turned on for selecting a specific pixel, a predetermined voltage from a data signal in the first data line D1 is applied to a node A through the first TFT M1. Thereafter, the first gate line G1 is turned off. Until the first gate line G1 is turned on again, the storage capacitor $C_{STO}$ maintains the voltage at the node A, while the second TFT M2 functions as a drive switch for supplying the EL diode with a fixed current for emitting light.

In general, the drive switch is driven in the saturation region, and the drive current I depends on the following formula, $I=\frac{1}{2} X\mu_n C_o(W/L)(V_{GS}-V_{TH})^2$, where $\mu_n$ is the mobility of an electric field, $C_o$ is the capacitance of a gate insulating layer, W is the channel width, L is the channel length, $V_{GS}$ is the voltage at the gate and source electrodes, and $V_{TH}$ is the threshold voltage.

Unfortunately, as the display size of the ELD of the related art increases, the deviation in the threshold voltage $V_{TH}$ between the TFTs in each of the other pixels increases, especially on a large substrate. This occurs because the characteristics of the silicon film that constitute the TFTs are irregular throughout the whole pixel array. Specifically, when TFTs made of polycrystalline silicon are used as the switching devices, the irregularity in threshold voltage between the TFTs gets worse due to the difficulty in providing a polycrystalline film having silicon grains that are uniform throughout the whole surface of the substrate.

Therefore, the threshold voltage $V_{TH}$ of the second TFT differs from the first TFT in each pixel even though the same $V_{GS}$ is applied to the first and second TFTs. Thus, the brightness of the image throughout the display is not uniform as different amounts of current flows through the respective EL diodes that are driven by the switching devices in each of the pixels.

SUMMARY OF THE INVENTION

To overcome the problems described above, preferred embodiments of the present invention provide an ELD having uniform brightness throughout the whole display by supplying the respective EL diodes with uniform drive currents with the use of a current mirror, even though the $V_{TH}$ of the switching devices in each pixel is not the same.

A preferred embodiment of the present invention includes a substrate, a gate line on the substrate, a data line crossing the gate line, a first TFT for selecting an arbitrary pixel by a gate signal, wherein a gate of the first TFT is connected to the gate line, a current mirror for outputting a signal to the arbitrary pixel selected by the first TFT by receiving a data signal from the data line at the same time that the current mirror is being voltage driven, the current mirror including a second TFT and a third TFT, and an electro-luminescent diode connected to the current mirror, wherein the diode is driven by a signal output from the current mirror.

In another preferred embodiment of the present invention, a method of manufacturing an ELD includes the steps of providing a substrate, forming a gate line on the substrate, forming a data line that crosses the gate line, forming a first TFT for selecting an arbitrary pixel by a gate signal, and connecting a gate of the first TFT with the gate line, providing a current mirror that receives a data signal from the data line as the current mirror is being voltage driven, and outputs a signal to the arbitrary pixel selected by the first TFT, and providing an electro-luminescent diode for receiving the outputted signal of the current mirror.

In preferred embodiments of the present invention, the voltage is continuously supplied to the current mirror such that the current mirror is being voltage driven at the same time that the current mirror receives the data signal from the data line.

Thus, in the present invention, the ELD has uniform luminescence throughout the whole display despite variations in the $V_{TH}$ of the switching devices since the current that is output from the current mirror to the respective electro-luminescent diode is uniform throughout the whole display.

Other features, elements and advantages of the present invention will be described in detail below with reference to preferred embodiments of the present invention and the attached drawings.

BRIEF DESCRIPTION OF THE ATTACHED DRAWINGS

The present invention will become more fully understood from the detailed description given herein below and the accompanying drawings which are given by way of illustration only, and thus do not limit the present invention and wherein.

DETAILED DESCRIPTION OF PREFERRED EMBODIMENTS

Figure 1:
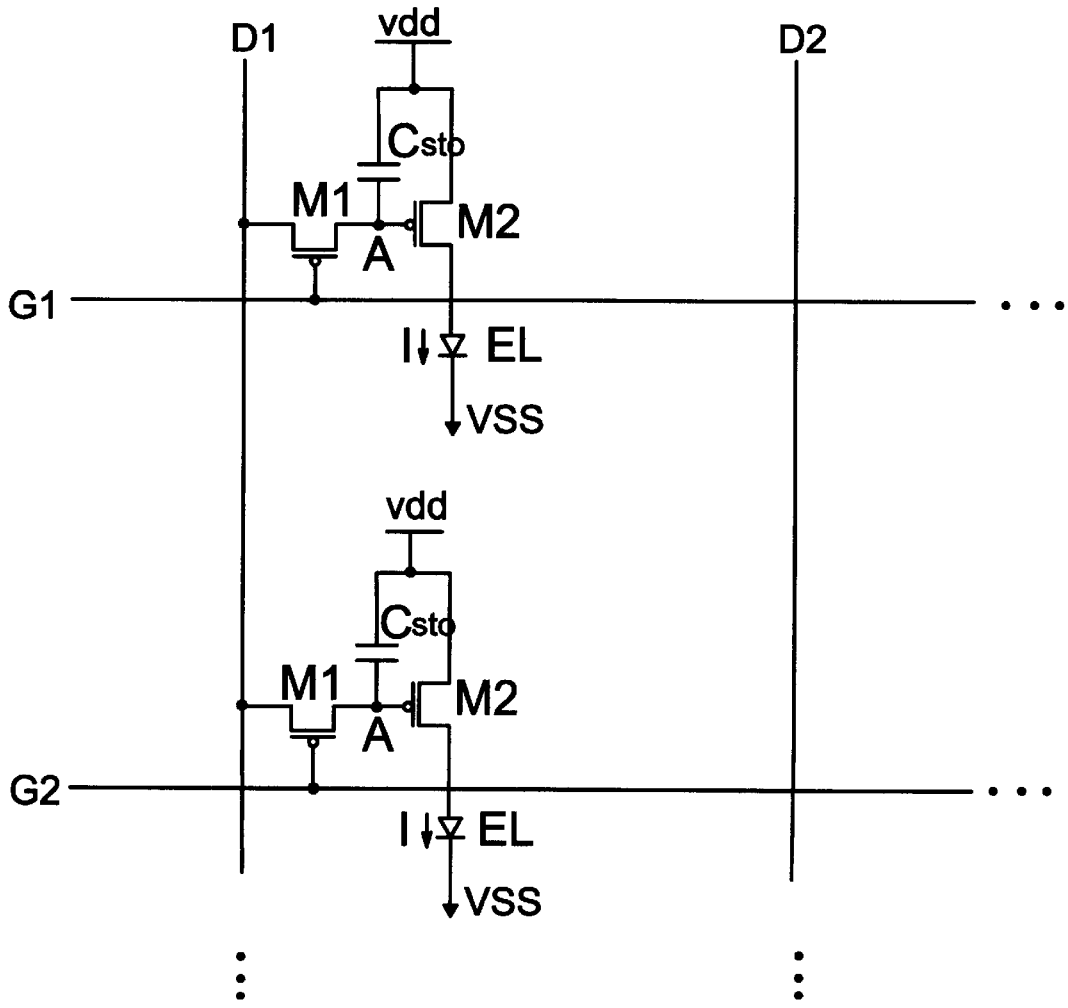
FIG. 1 RELATED ART
FIG. 1 is a schematic view of an equivalent circuit of an ELD according to a related art.
Figure 2:
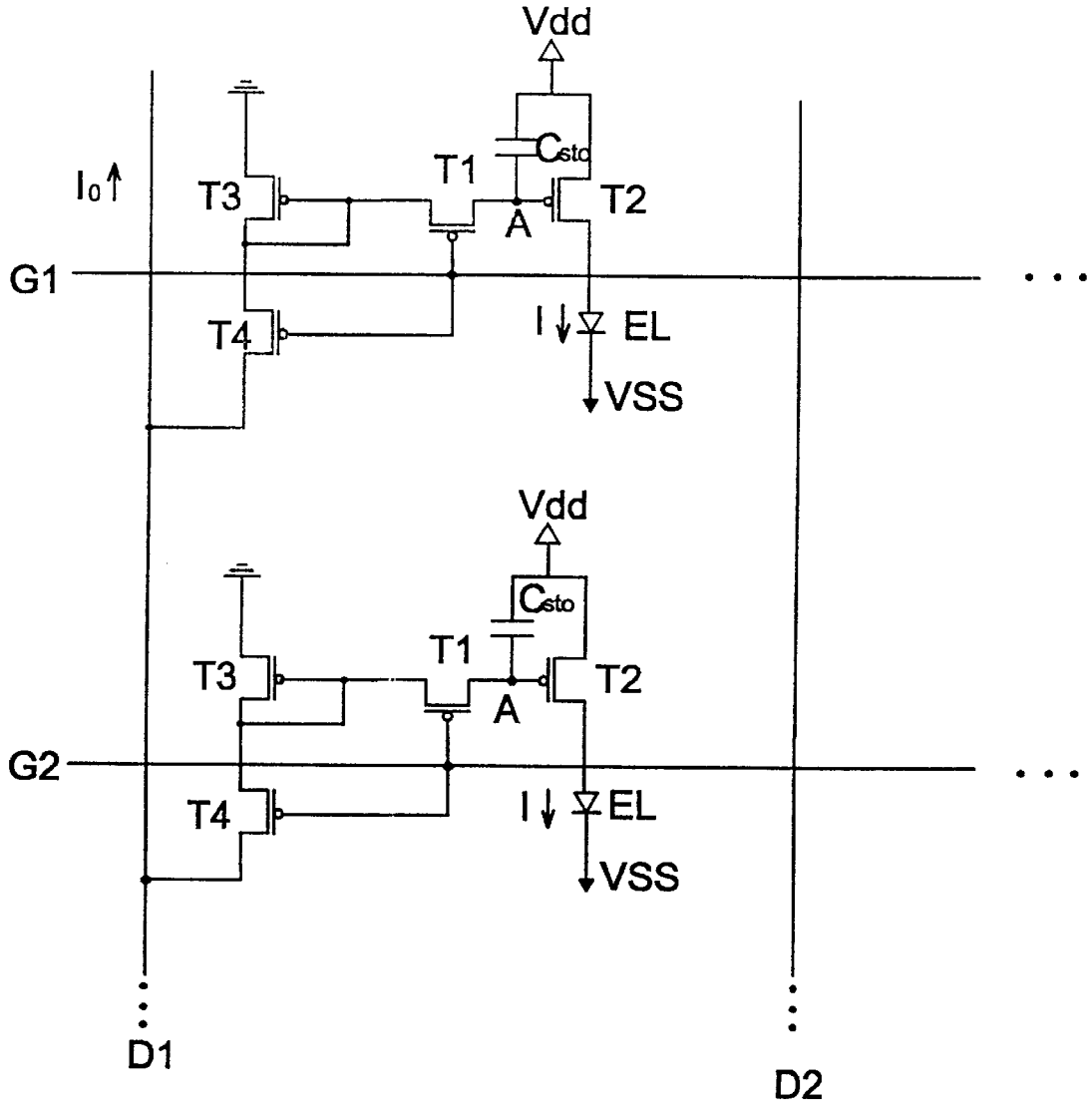
FIG. 2 is a schematic view of an equivalent circuit of an ELD according to a first preferred embodiment of the present invention.

FIG. 2 is a schematic view of an equivalent circuit of an ELD according to a first preferred embodiment of the present invention where a current mirror is provided for a general ELD. Referring to FIG. 2, a plurality of pixel regions are defined by a plurality of gate lines, for example, G1 and G2, and data lines, for example, D1 and D2, which are arranged to intersect each other. For simplicity, the discussion will focus on how the ELD functions in one of the pixels.

First, the TFT T1 is connected to the intersection of the gate line G1 and data, line D1. In a pixel, a storage capacitor $C_{STO}$ and a gate of the second TFT T2 are connected to a drain of the first TFT T1 in parallel. A diode EL, which is a light-emitting device, is connected to a drain of the second TFT T2. Note that the above-described structure is similar to that of the related art thus far.

However, in the present preferred embodiment of the present invention, a current mirror, which includes a second TFT T2 and a third TFT T3, is connected between the data line and the diode EL. The second TFT T2 drives the diode EL, and the third TFT T3 has its own gate connected to its own drain as well as a source of the first TFT T1.

Relating the first TFT T1 to the third TFT T3, a drain of the third TFT T3 is connected in parallel to the data line D1, the drain of the third TFT T3 is connected to a gate of the third TFT T3, a source of the first TFT T1 is connected to the gate of the third TFT T3, and a drain of the first TFT T1 is connected to a gate of the second TFT T2.

Because both the second and third TFTs T2 and T3 constitute the current mirror that operates in the saturation region, the driving current I that flows through the drive switch is I={{LEFT{W} over {L}RIGHT)}_{T3}} over {{LEFT({W} over {L}RIGHT)}$_{13}$ {{T2}}}TIMES{1}_{0}. Namely, the current "$I_0$" is the input for the current mirror, which includes the third and second TFTs T3 and T2 as drive switches for driving the diode EL, and outputs the current "I," such that the current I is not affected by the level of the threshold voltage $V_{TH}$ of the third and second TFTs T3 and T2. Because the ELD of preferred embodiments of the present invention supplies each of the pixels with uniform data current $I_O$, all of the pixels also have an uniform current I that flows through the light-emitting diodes EL in each of the pixels. In other words, the current flowing through the diode EL is controlled by the current $I_0$ although there exists deviations in the threshold voltage $V_{TH}$ in the switching devices in each of the pixels. Thus, uniform current flows through all of the pixels, producing uniform light-emission from the diodes EL. Therefore, preferred embodiments of the present invention provide an ELD which has uniform brightness throughout the whole ELD.

Note that the ELD of preferred embodiments of the present invention includes a fourth TFT T4 including a gate that is connected to the gate lines. In a pixel, the gate of the fourth TFT T4 is connected to the gate of the first TFT T1, a drain of the fourth TFT T4 is connected to a drain of the third TFT T3, and a source of the fourth TFT T4 is connected to the data line. Thus, the first and fourth TFTs T1 and T4 are driven simultaneously by the gate signal of the gate line. Therefore, a data signal is input to a selected pixel as the fourth TFT T4 of the pixel is selected by the gate signal and is the only one turned on. Accordingly, preferred embodiments of the present invention make possible to operate each of the pixels independently.

A gate driver (not shown in the drawing) is connected to one stage of the gate lines supplying each of the gate lines with a proper scanning signal. A data driver (not shown in the drawing) is connected to one stage of the data lines, supplying each of the data lines with data voltage for driving a corresponding diode EL.

Generally, it is possible to carry out modeling on a data driver. However, the ELD of the first preferred embodiment of the present invention requires a current supply source which supplies current in accordance with brightness to activate the current mirror. More specifically, in the ELD of the present preferred embodiment, a data driver is the current supply source that supplies the data lines with current.

The operation of the ELD according to the first preferred embodiment of the present invention is explained by the following description. Gate voltage is applied to an arbitrary gate line, for example, a first gate line G1 by a gate driver (not shown in the drawing), thereby turning on the first and fourth TFTs T1 and T4 simultaneously. In the mean time, a data signal that is transferred from a data driver (not shown in the drawing) through a data line is input to a selected pixel through the fourth TFT T4, which was already turned on by the gate signal. The data signal that is applied to the pixel via the fourth TFT T4 is applied to a node A, turning off the gate line G1. Note that the first and fourth TFTs T1 and T4 are turned off simultaneously.

Until the first gate line G1 is selected again, a storage capacitor $C_{STO}$ maintains the voltage at the node A to turn on the second TFT T2 to function as a driving switch for supplying the diode EL with a fixed current for emitting light. Note that the current that is flowing in the diode EL, which is connected to the second TFT T2 by the current mirror including the third and second TFTs T3 and T2, is controlled by the initial data current that is input to the third TFT T3.

Therefore, the data signal inputted to each of the pixel regions by the current mirror is not affected by the magnitude of the threshold voltage $V_{TH}$ of the TFTs in each pixel. Instead, the data signal supplies the diode EL of each pixel with uniform current, thereby driving the diode EL. Because the pixels cover a large area, the data current that is input to each pixel also flows into and drives each diode EL despite fluctuations in the threshold voltage $V_{TH}$ of the TFTs provided in each pixel. Thus, each of the pixels provide the same brightness because each of the diodes in each of the pixels have the same amount of current for driving the diodes.

Figure 3:
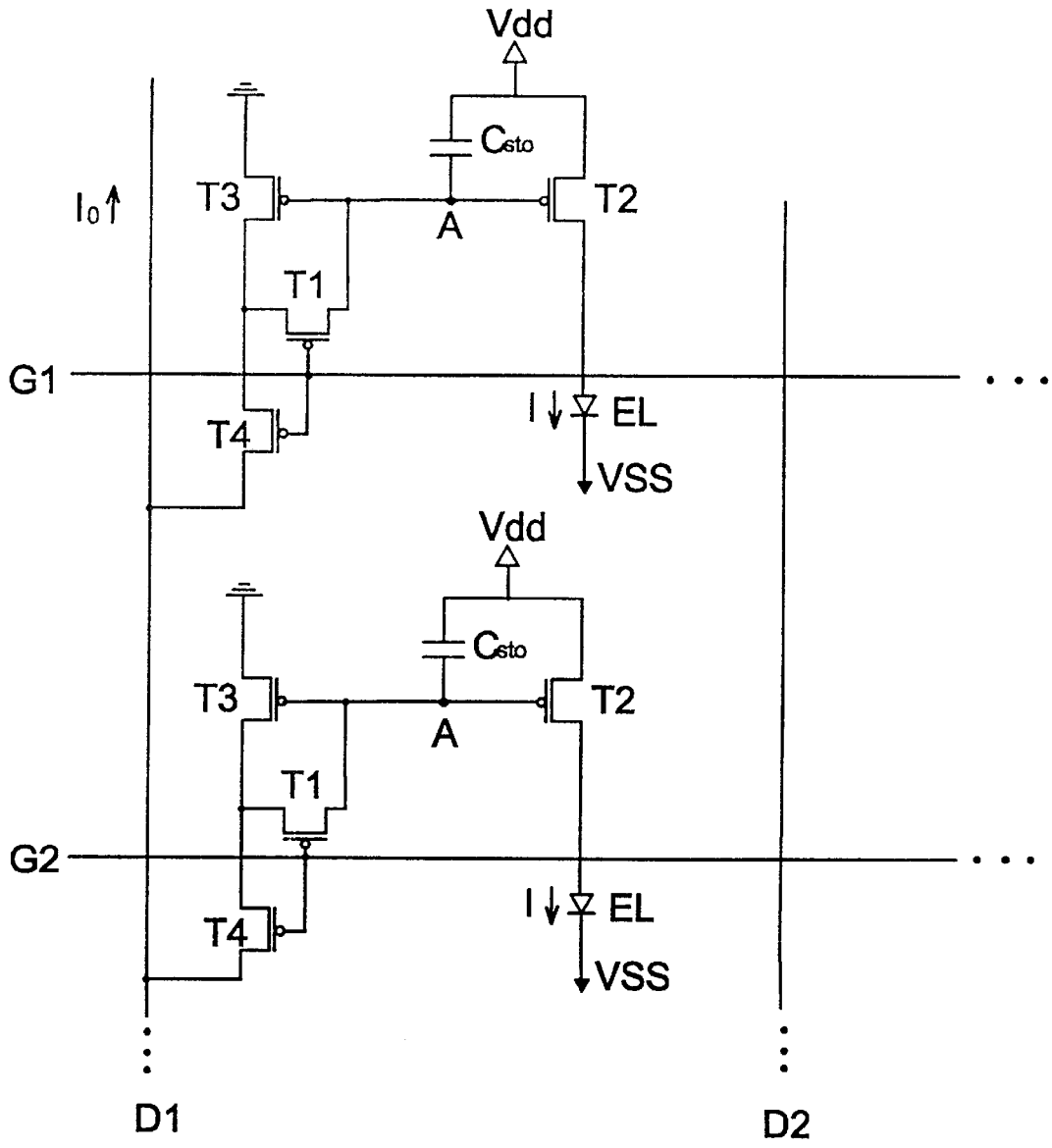
FIG. 3 is a schematic view of an equivalent circuit of an ELD according to a second preferred embodiment of the present invention.

FIG. 3 is a schematic view of an equivalent circuit of an ELD according to a second preferred embodiment of the present invention. Referring to FIG. 3, a current mirror including a third TFT T3 and a second TFT T2 drives a diode EL, a first TFT T1, which selects a pixel region by a gate signal, is connected between a drain and gate of the third TFT T3. Note that all other elements are arranged the same as the first preferred embodiment of the present invention.

Relating the first TFT T1 to the third TFT T3, a drain of the third TFT T3 is connected to the data line, a drain of the first TFT T1 is connected to the drain of the third TFT T3, a gate of the third TFT T3 is connected to a source of the first TFT T1, and a gate of the second TFT T2 is connected to the gate of the third TFT T3.

In the above-described arrangement, a pixel is selected by the first TFT T1, which functions as a selection TFT, thereby supplying the selected pixel with current from a current driver. Then, current starts to flow in the second TFT T2, which functions as a driving TFT for the current mirror. Therefore, the diode EL emits light when the TFT T2 is being driven. Note that the operation and effect of the second preferred embodiment is as good as the first preferred embodiment.

Figure 4:
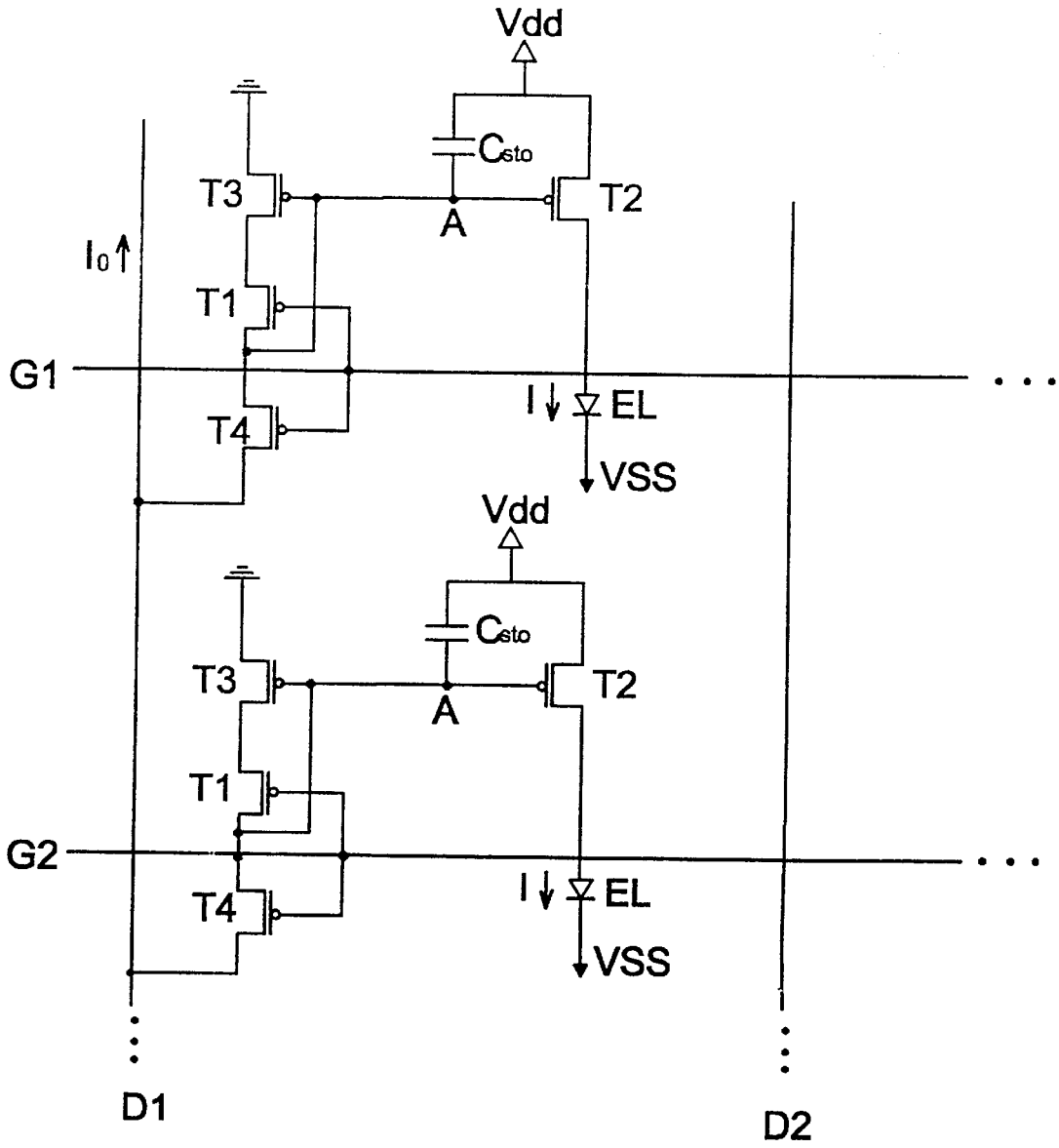
FIG. 4 is a schematic view of an equivalent circuit of an ELD according to a third preferred embodiment of the present invention.

FIG. 4 is a schematic of an equivalent circuit of an ELD according to a third preferred embodiment of the present invention. Referring to FIG. 4, a current mirror includes a third TFT T3 and a second TFT T2, where the second TFT T2 functions as a driving TFT for driving a diode EL. A first TFT T1 functions as a selecting TFT and is connected between the gates of the third and fourth TFTs T3 and T4, and the drain of the first TFT T1 is connected to the gate of the third TFT T3. Note that all other elements are preferably the same as the first preferred embodiment of the present invention.

Relating the first TFT T1 to the third TFT T3, the drain of the first TFT T1 is connected to the data line, the drain of the third TFT T3 is connected to the source of the first TFT T1, the gate of the third TFT T3 is connected to the drain of the first TFT T1, and the gate of the second TFT T2 is connected to the gate of the third TFT T3.

In the above-described arrangement, a pixel is selected by the first TFT T1, which functions as a selecting TFT, thereby supplying the selected pixel with current from a current driver. Then, the current starts to flow in the second TFT T2, which functions as a driving TFT for the current mirror. Then, the diode EL emits light by the current supplied by the driving TFT T2. Note that the operation and effect of the third preferred embodiment is as good as the first preferred embodiment.

Note that preferred embodiments of the present invention are provided with an ELD arrangement having PMOS as the TFT, but in other embodiments, NMOS can be used as the TFTs.

Accordingly, preferred embodiments of the present invention provides an ELD which has uniform brightness by providing the each of the pixels that supply the respective diodes EL with a uniform drive current by providing current mirrors for each of the diodes EL in each of the pixels.

While the invention has been particularly shown and described with reference to preferred embodiments thereof, it will be understood by those skilled in the art that the foregoing and other changes in form and details may be made therein without departing from the spirit and scope of the invention.

What is claimed is:

1. An electro-luminescent display comprising:

a substrate;

a gate line on the substrate;

a data line crossing the gate line;

a first TFT for selecting an arbitrary pixel by a gate signal, wherein a gate of the first TFT is connected to the gate line;

a current mirror for outputting a signal to the arbitrary pixel selected by the first TFT by receiving a data signal from the data line at the same time that the current mirror is being voltage driven, wherein the current mirror includes a second TFT and a third TFT;

wherein a drain of the third TFT is connected to a drain of the first TFT, a source of the first TFT is connected to a gate of the third TFT, and the gate of the third TFT is connected to a gate of the second TFT;

an electro-luminescent diode connected to the current mirror, wherein the diode is driven by the output signal of the current mirror.

2. The electro-luminescent display according to claim 1, further comprising a data driver defining a current driving source connected to a stage of the data line.

3. The electro-luminescent display according to claim 1, wherein the electro-luminescent diode is connected to the drain of the second TFT.

4. The electro-luminescent display according to claim 1, further comprising a fourth TFT disposed between the data line, the first TFT, and the third TFT, thereby the first TFT and the third TFT are connected to the data line.

5. The electroluminescent display according to claim 4, wherein the fourth TFT includes a gate connected to the gate of the first TFT and the gate line, and a source is connected to the drain of the third TFT and the drain of the first TFT.

6. A method of manufacturing an electro-luminescent display comprising the steps of:

providing a substrate;

defining a gate line on the substrate;

defining a data line that crosses the gate line;

providing a first TFT for selecting an arbitrary pixel by a gate signal, and connecting a gate of the first TFT with the gate line;

providing a current mirror including a second TFT and a third TFT that receives a data signal from the data line as the current mirror is being voltage driven, and outputs a signal to the arbitrary pixel selected by the first TFT;

connecting a drain of the third TFT to a drain of the first TFT;

connecting a source of the first TFT to a gate of the third TFT;

connecting the gate of the third TFT to a gate of the second TFT; and providing an electro-luminescent diode for receiving the output signal of the current mirror.

7. The method of claim 6, further comprising the step of providing a fourth TFT disposed between the data line, the first TFT, and the third TFT, thereby the first TFT and the third TFT are connected to the data line.

8. The method of claim 7, wherein the step of providing the fourth TFT includes:

connecting a gate of the fourth TFT to the gate of the first TFT and the gate line; and connecting a source of the fourth TFT to the drain of the third TFT and the drain of the first TFT.

* * * * *